US005577344A

United States Patent [19]

Zaremba et al.

[11] Patent Number: 5,577,344

[45] Date of Patent: Nov. 26, 1996

[54] PARTY RISER

[76] Inventors: George J. Zaremba, 6630 N. Kostner, Lincolnwood, Ill. 60646; James M. Blankfield, 6325 N. Sheridan Rd., Unit 1304, Chicago, Ill. 60660

[21] Appl. No.: 233,614

[22] Filed: Apr. 22, 1994

Related U.S. Application Data

[63] Continuation-in-part of Ser. No. 14,267, Feb. 5, 1993, abandoned.

[51] Int. Cl.[6] ..... A47G 7/00

[52] U.S. Cl. ..... 47/39; 47/83; 211/205; 108/150; 108/156

[58] Field of Search ..... 108/150, 156, 108/158; 47/36, 36 C, 82, 83; 211/186, 205

[56] References Cited

U.S. PATENT DOCUMENTS

| | | | |
|---|---|---|---|
| 1,928,799 | 10/1933 | Stevens | 47/39 |
| 2,720,056 | 10/1955 | Levy | 47/83 |
| 3,176,676 | 4/1965 | Caldwell | 108/150 |
| 3,687,092 | 8/1972 | Manning | 108/158 |
| 3,747,268 | 7/1973 | Linder | 47/39 C |
| 4,158,336 | 6/1979 | Brescia | 108/156 |
| 4,345,526 | 8/1982 | Streit | 108/111 |
| 4,383,488 | 5/1983 | Macho | 108/156 |
| 4,467,927 | 8/1984 | Nathan | 211/153 |
| 4,574,709 | 3/1986 | Lackey | 108/150 |
| 4,833,999 | 5/1989 | Rhoads | 108/38 |
| 4,865,283 | 9/1989 | Parker | 248/159 |

FOREIGN PATENT DOCUMENTS

| | | | |
|---|---|---|---|
| 2260076 | 10/1991 | United Kingdom | 108/91 |

*Primary Examiner*—Henry E. Raduazo
*Attorney, Agent, or Firm*—Adrienne B. Naumann

[57] ABSTRACT

A portable party riser, or pedestal-type stand, is provided, consisting of several container-bases and a thin cylindrical rigid stem for support. The container-bases are manually connected to this stem by fitting either of the two ends of the support tightly into the appropriate socket or hub on either surface of the flange of each container-base. The structure is generally supported by a bottom container acting as the base, and resting upon a horizontal surface such as a floor or table top. As such, it is an excellent device for placing decorative arrangements, because it is leakproof without a gluing or other adhesive means.

22 Claims, 10 Drawing Sheets

PARTY RISER

This application is a continuation-in-part of U.S. application Ser. No. 08/014,267, filed Feb. 5, 1993 abandoned.

BACKGROUND OF THE INVENTION

The present inventions relates to a structure which functions as a stand and container for floral arrangements and plants. More particularly, the present invention, hereinafter referred to as the party riser, relates to a modular set with reversible container-bases which may hold flower arrangements either singly as one raised flower arrangement, or as multiple combinations of flower arrangements. Such arrangements can be in the form of two-tiered arrangements, or multi-tiered arrangements, as well as bridal bouquets.

There has been a long-standing need in the floral industry for a modular flower or plant display stand for parties, weddings, funerals, holidays, and religious events, which stand may quickly be assembled and disassembled. There are also constraints of weight, cost, and rigidity of existing floral or plant display stands which cannot easily be moved, grouped or rearranged individually within practical cost and time constraints.

Others have suggested numerous devices for holding plants or flowers for decorative displays. For instance, an obvious choice might be simply to construct a completely rigid structure with a widened based and top, both of which will hold the plants or flowers. However, others have recognized potential problems with this choice. For example, U.S. Pat. No. 4,345,526 (Streit) disclosed a plastic display stand formed from a set of shelves supported by a pair of interlocking complementary v-shaped shelf supports. However, this type of display case is more amenable to featuring new products in a commercial setting where quick assembly and disassembly is not required.

U.S. Pat. No. 4,574,709 (Lackey) discloses a shelf element with a support. Each shelf element affords a multiplicity of holes for receiving mounting posts arranged so that unused shelf apertures are partially closed so as not to interfere with the function of a shelf as a supporting device. This arrangement, although adaptable, requires excessive modification and expenditure of time to arrange for different displays of goods.

U.S. Pat. No. 4,865,283 (Parker) discloses a merchandising display stand with tiered article support racks or trays which are interchangeably mounted for rotational movement with respect to a vertical support column. Because this device requires a plurality of vertically interlocking post members for revolving the displays, it is not conducive to speed in assembly of floral arrangements for a party or wedding.

U.S. Pat. No. 4,833,999 (Rhoades) discloses a portable filleting table consisting of a table top and base. The table top and base may be rotated with respect to one another, and the entire table can be folded into the configuration of a carrying case. Such features, however, although useful on a fishing trip, are not generally necessary for the display of flowers, because (1) the top and base are not quickly interchangeable with each other; and (2) the top and base will not hold water without leaking.

U.S. Pat. No. 4,467,927 (Nathan) discloses a molded tray for a display stand, and which is supported by tubular posts. Each shelf has channel type elements, which are not necessary for floral displays and the tubular posts take time to assemble on- site, a feature which is distasteful to most florists.

None of the foregoing display structures have a pair of reversible easily positioned container-bases to hold floral or plant arrangements formed by a simple rigid cylindrical stemlike support, and which directly hold the water, dirt, and floral foam required. Also, in the invention the bottom member can hold water for a flower or plant arrangement, as can the top member in a leakproof, watertight manner without glue or other adhesive means.

SUMMARY OF THE INVENTION

To solve this problem long-standing in the art, the present invention, hereinafter referred to as "the party riser," provides an improved stand or pedestal (in effect, a pedestal and flower/plant arranger combined into one). The user can manually arrange flowers, plants, balloons, and other decorations in separate container-bases and assemble such structures on site in seconds. The container-bases which function as modified design-bowls, can be reversed for arranging flowers or balloons, which in turn can be used as either the supporting member or upper member of my structure. In addition, the invention has possibilities as a simple pedestal, as well as for raised two-tier arrangements, etc. In fact, in a multi-tier arrangement, several container-bases can be used to hold water and a floral or plant arrangement.

Accordingly, an object of the present invention is to provide an improved stand for floral arrangements that facilitates creativity of floral arrangements as well as their mechanical setup at events such as weddings, corporate functions, bar mitzvahs, bat mitzahs, and other festivities. Moreover, these advantages occur without undue effort on the part of the florists or others who are hired to provide the decorations.

Another object of the present invention is to provide an improved, stronger yet lightweight stand made from durable, low cost resins to support floral, plant or balloon arrangements.

Yet another object of the present invention is to provide a three piece modular set which can be assembled onsite in seconds without the inconvenience of a gluing or other adhesive means.

A further object of the invention is to provide interchangeable container-bases, so that the florist can create a variety of arrangements by using basically the same three components of the invention.

Another object of the invention over the prior art is to have a flat bottomed container-base which can hold water for a flower arrangement, as well as an upper container-base, which can similarly hold water for a flower or plant arrangement.

Another object of the invention is that removing the top or upper container-base is a convenient method for taking the flower arrangement to another destination. In this manner our container-base can serve as a table gift of flowers or plants in a water-tight container.

Another object of the invention is to create a three piece modular set that can be assembled after use and stored compactly. Another object of the present invention is to simplify the delivery of the floral arrangement, insofar as the container-bases with the arrangements may be delivered flat on the floor of the delivery vehicle and then lifted and placed upon stems of the improved stand, or party riser, onsite at the destination.

Still another object of the present invention is to provide various heights by cutting the component stems of my invention to different lengths.

Another object of the present invention is to permit the florist to assemble a creation in a flat container that sits steadily on a work bench at the florist's preferred level for manual work rather than working directly on a raised pedestal that requires working at eye level or correspondingly, placing the pedestal on the floor to facilitate working at the preferred level.

These and still other objects and advantages of the invention will become apparent from the following description of the preferred embodiment of the present invention.

BRIEF DESCRIPTION OF THE DRAWINGS

The invention may be better understood by reference to the drawings accompanying this specification.

DETAILED DESCRIPTION OF THE INVENTION

Figure 1:
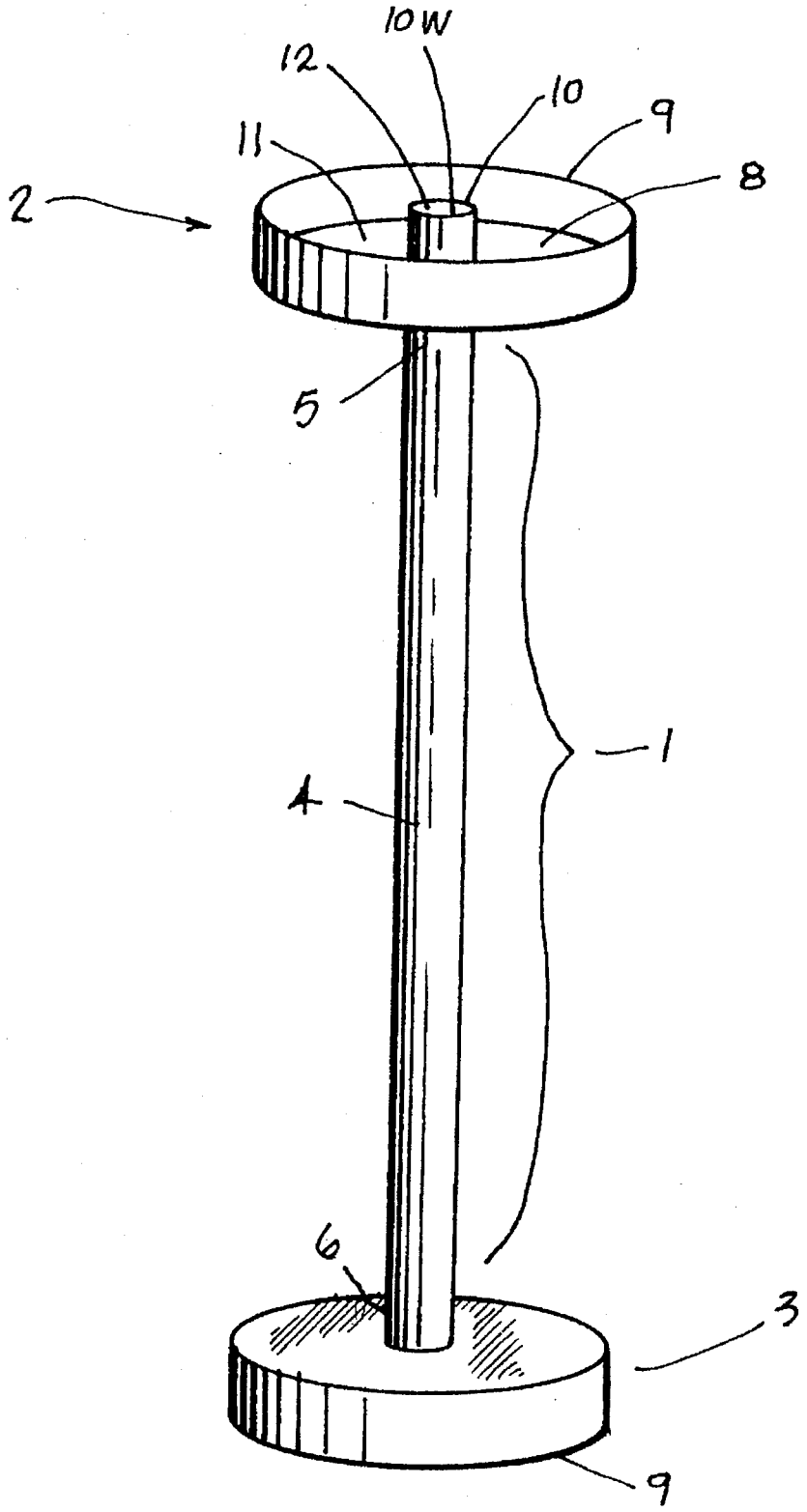
FIG. 1 is a side view of the party riser with a top and bottom container-base connected together by a cylindrical stem.

The present invention, commercially known as, and hereinafter referred to as "the party riser," is actually a modified pedestal-type stand for elevating a floral or plant arrangement above a horizontal surface such as a table-top or floor. In the preferred embodiment, the stand or pedestal 1 is completely rigid and stands upright without bending. The floral or plant arrangement is made directly inside a component of my invention resembling a modified dish-like shelf 2, and is more specifically referred to herein as a container-base. The entire structure comprising invention in the preferred embodiment generally consists of the top shelf 2 and bottom container-base 3, interconnected by a rigid cylindrical thin stem 4 for support, and which stem may be hollow or solid. In the preferred embodiment, the stem is one, to one-and-one-quarter inch in diameter.

Also in the preferred embodiment, the top and bottom container-bases are identical in shape and dimensions so that they can be interchangeable. The structure is assembled and disassembled by quickly manually engaging or disengaging the ends of the stem 4 into sockets or hubs 10 which are integrally molded with the container-bases. For larger arrangements, a relatively larger base may be required for increased stability.

In the following text, the term "component" applies to all parts of a party riser which are described in more detail, infra.

In the preferred embodiment, as a first component each containerbase has a dish-like appearance, with a generally circular flat flange 8. The upper surface 11 of flange 8 of container-base 2 or 3 has a hub 10 of a predetermined height. The hub 10 contains a web 10W having top and bottom surfaces and defining coaxially an upper socket 12 and a lower recessed socket 13. Lower socket 13 also appears on the lower surface 11*a* of flange 8.

Flange 8 extends the bottom of lower socket 13, or the lower surface of hub 10, to a peripheral raised rim 9 with an inner and outer surface. The vertical coaxial rim 9 serves to keep the floral or plant arrangements in a sufficient supply of water and/or soil. It also supplies sufficient space for a block of floral foam, which would support a floral arrangement directly in water within any container-base.

To assemble the preferred embodiment of the invention, one end of the rigid stem is pushed into the interior of a lower recessed socket 13 of the bottom container-base which will be the support on a horizontal surface. The periphery of rim 9 on bottom container base 3 contains the actual contact points when the bottom container-base functions solely as a support on a horizontal surface. The second end of the stem is pushed into the interior of lower socket 13 of the top container-base (which generally will hold water, plants, soil, and flowers).

The invention is purchased by the consumer as a kit. Although the container-bases may be of different sizes and shapes, the two ends of each and every stem must be identically shaped and of an appropriate diameter to frictionally engage a socket. The sockets must be identical in dimension and contour with respect to any container-base. In this manner each of the two ends of every stem can snugly fit, as an interference fit, into sockets on either the top or lower surface of any container-base in the kit.

Generally speaking with respect to other embodiments and components of a kit, a container-base may be constructed to have two or more hubs to receive a plurality of stems on either surface of its flange. Under these circumstances, the invention would include an embodiment in which there are two or more stems connecting to the top container-base, thereby giving the top container-base extra strength and stability to support heavier floral or plant arrangements.

In another embodiment, the sockets within a container-base can be arranged to form an equilateral triangle configuration. The stems attached thereto, and parallel to each other, thereby connect a first larger top container-base to a second larger bottom container-base. As a multi-stem and , multi-container-base embodiment, each stem can connect each of a plurality of relatively smaller bottom container-bases to a relatively larger top container-base.

This last arrangement can be altered by using a larger container-base as the bottom member connected by three stems to three relatively smaller top container-bases which contain floral arrangements. As still another variation of this embodiment, the three top small container-bases can be supported by different lengths of stem, so as to give a layered, or staggered appearance to the flowers. In this last variation, the situation is economical because extra pieces of stem can be used subsequently to create other party risers.

In FIG. 1 the preferred embodiment of the party riser, shown generally at 1, has a top member and a bottom member, here represented by top and bottom circular container-bases 2 and 3. In the preferred embodiment, 2 and 3 are identical in shape and dimensions, so that they are interchangeable as top or bottom members of the party riser 1. Top and bottom container-bases 2 and 3 are connected to each other by a thin rigid cylindrical stem 4 for support with upper and lower ends 5 and 6 respectively. Again referring to FIG. 1, there are additional components to a container-base, here container-base 2: a flange 8, rim 9, a hub 10, and upper socket 12 and web 10W within the hub.

The entire party riser 1 is approximately 24" or 60 centimeters (cm.) high in the preferred embodiment. Also in the preferred embodiment, the circular container-base 2 at the top of stem 4 is approximately 8 inches or 19.5 centimeters (cm.) in diameter and approximately 1.5 inches or 3.7 cm. in depth. The depth of the container-bases 2 and 3 at rim 9 may be increased to accommodate the soil in which the plants may be placed directly.

Container-base 3, again as also seen in FIG. 1, which supports the preferred embodiment on a horizontal surface, can be modified for a more asymmetrical appearance or for more lateral support. However, in the preferred embodiment the container-base 3 in FIG. 1 should be functionally interchangeable with container-base 2 as either the top or bottom member of the entire party riser 1.

Figure 2:
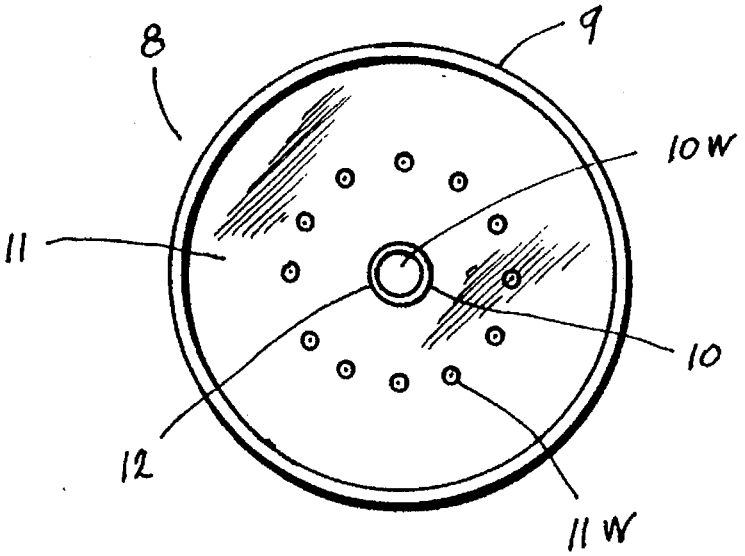
FIG. 2 is a diagrammatic view of the upper surface of the flange of a container-base with spikes to hold foam blocks.

As seen in FIG. 1, and as shown in FIG. 2 looking down upon container-base 2 or 3, in the preferred embodiment each containerbase has as its bottom component a generally flat horizontal circular flange 8 with an upper surface 11. In the center of flange 8 is a partially hollow coaxially elongated upwardly extending circular hub 10 which contains upper socket 12. This socket 12 can be the female member to either end 5 or 6 of stem 4.

In the preferred embodiment the hub 10 is approximately one and one-half inches or 3.3 cm. in height and approximately one and one quarter inches, or 3.2 cm in interior diameter. As also seen in partial view in FIG. 1, hub 10 has a central web 10W which physically limits and defines upper socket 12 and a lower socket 13. Web 10W also limits the penetration of stem 4 from either upper 12 or lower socket 13, and prevents the loss of water around stem 4. In the preferred embodiment, hub 10 is surrounded by spikes 11w to hold a block of floral foam in place. The spikes must be shorter than the interior height of the container-base rim 9 and strategically placed around hub 10.

In another embodiment of the invention, the hub 10 is narrower in diameter than the stem 4, so that upper socket 12 within the hub becomes the male member to a hollow stem. In other words, the stem in this embodiment fits over the hub 10 instead of frictionally fitting within upper socket 12 of hub 10.

Figure 3:
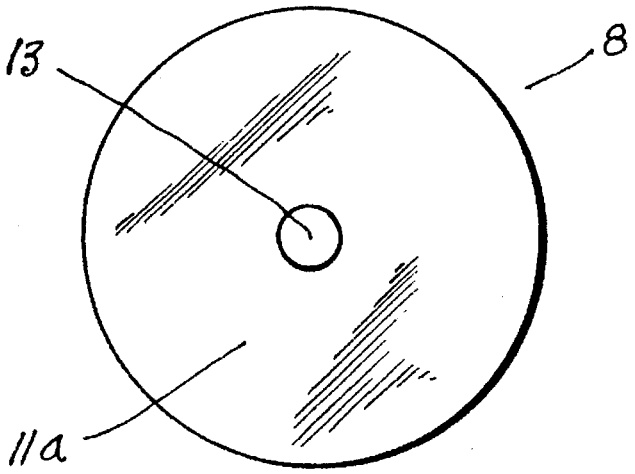
FIG. 3 is a diagrammatic view of the lower surface of the flange of a container-base.

In FIG. 3, looking towards the lower surface **11*a* of flange 8 of container-base 2 or 3, in the preferred embodiment there is a cylindrical recessed socket 13 coaxially located to socket 12 and also located within hub 10 (not shown in this view). As seen in FIG. 1 in combination with FIG. 3, flange 8 extends from the lower surface of hub 10 (or bottom of lower socket 13) to peripheral rim 9. In the preferred embodiment, this socket 13 is approximately one and one quarter inches or 3.2 cm. in diameter, and approximately three-quarters of an inch or 1.7 cm. in depth. Because of the internal structure of hub 10, either of container-bases 2 or 3 may be attached to a stem 4 by ends 5 or 6 and function as a top or bottom member of the party riser 1**.

Referring again to FIG. 1, in the preferred embodiment, the floral or plant arrangement is placed directly inside top container-base 2. Here, the plants or flowers, along with the floral foam, water, and/or soil, rest directly on the upper surface 11 of flange 8, and are directly supported by stem 4. To assemble the preferred embodiment of the invention as illustrated in FIG. 1, the upper end of stem 4, e.g., 5, is manually inserted into the cylindrical recessed socket 13 on the lower surface **11*a* of flange 8 of container-base 2. The lower end 6 of stem 4 is inserted into socket 13 of bottom container-base 3 which rests on a horizontal surface. The decorations, such as floral arrangements and balloons, are then placed in container-base 2**.

Figure 4:
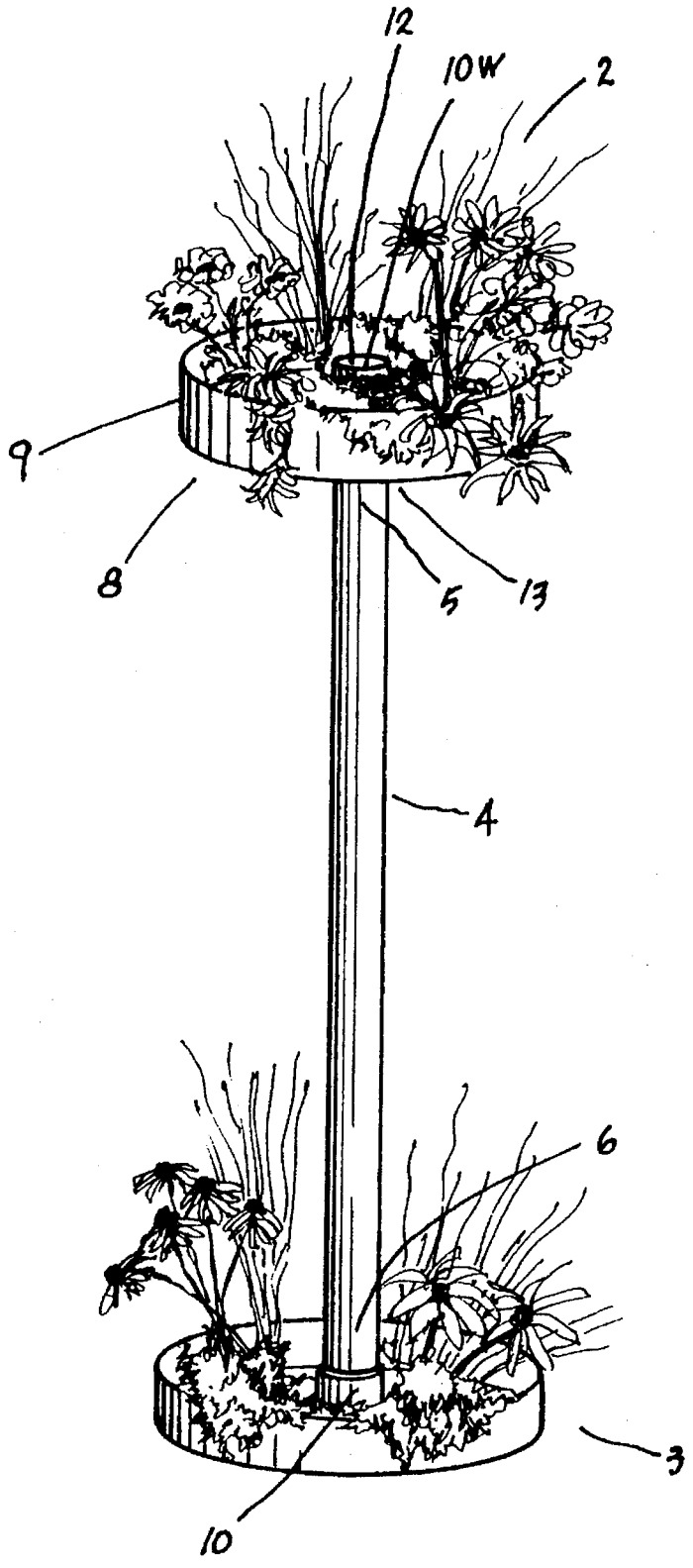
FIG. 4 demonstrates upper and lower container-bases attached to the stem, and both contain foliage.

FIG. 4 illustrates a different configuration for a two container-base embodiment of party riser 1. Container-base 2 is positioned by inserting upper end 5 of stem 4 into the cylindrical recessed socket 13 (not shown in this view). Bottom container-base 3 is connected by inserting lower end 6 into socket 12 of hub 10. This configuration creates an arrangement in which both container-bases can hold flowers or plants.

Figure 5:
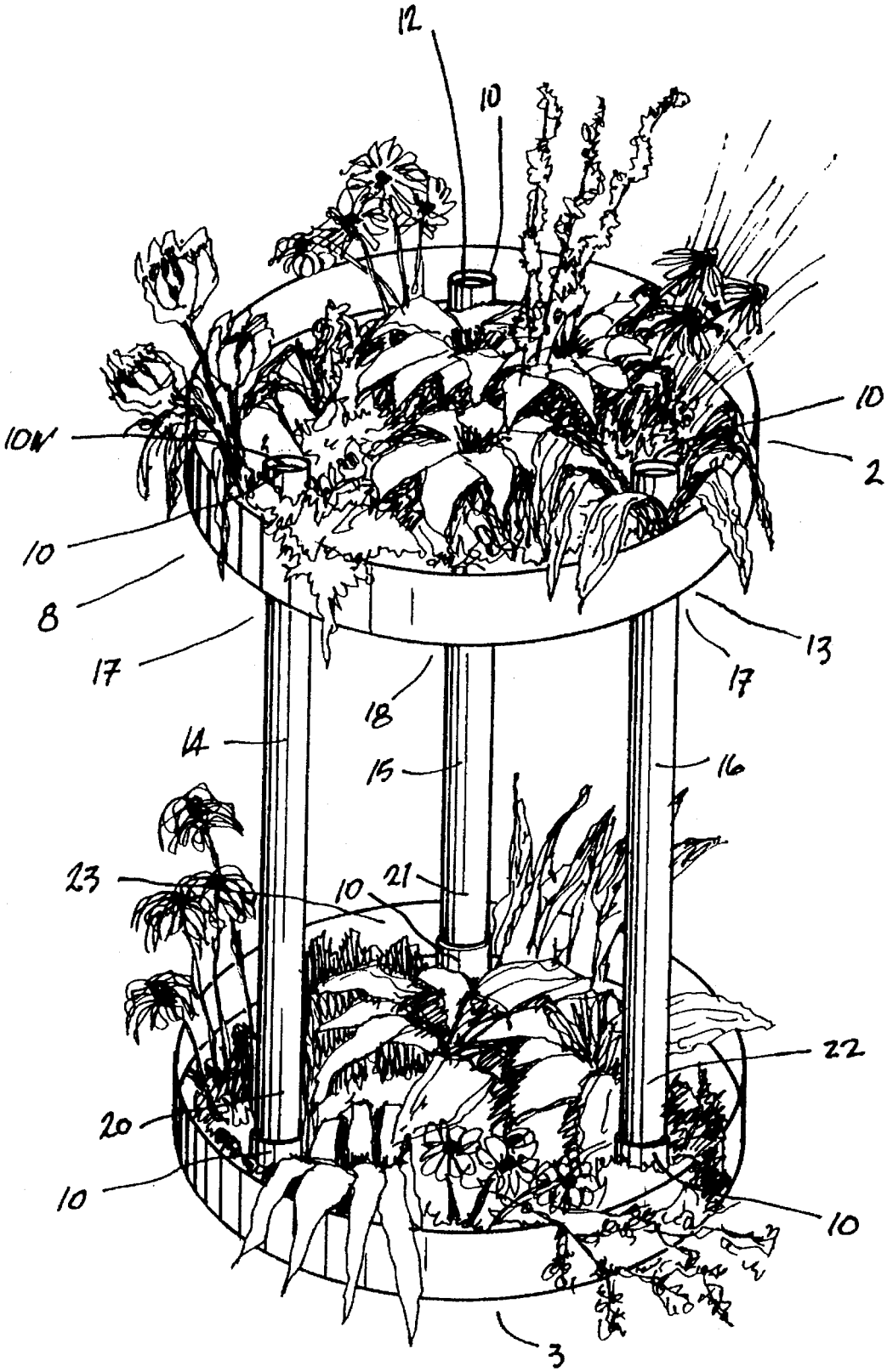
FIG. 5 is a diagram of a large top container-base connected to and supported by three stems rising from a single lower container-base.

In the following figures, in which the party riser 1 is comprised of multiple container-bases and stems, recessed socket 13 and upper socket 12 are often indicated as to their relative positions. However, sockets 12, 13 are not always explicitly shown because of the drawing perspective:

FIG. 5 illustrates a plurality of stems 14, 15, 16, which are identical in structure to stem 4, but which may vary within the scope of the invention as to length. Stems 14,15,16 are connected to container-base 2 by recessed cylindrical sockets 17, 18, 19 (not shown) respectively. These sockets are identical in structure and dimensions to that described for the preferred embodiment socket 13, supra. Each of the lower ends 20, 21, 22 of stems 14,15,16 are attached to bottom container-base 3 by three sockets 12 within three separate hubs 10, coaxially located to sockets 13, and at positions such as 23. This plurality of stems provides additional support for heavier flowers and plants in top container-base 2. This variation also provides a bottom container-base 3 which provides stable support on a horizontal surface while holding flowers or plants. In the embodiment shown in FIG. 5, the three stems 14, 15, 16, are parallel to each other and in a triangular configuration.

Figure 6A:
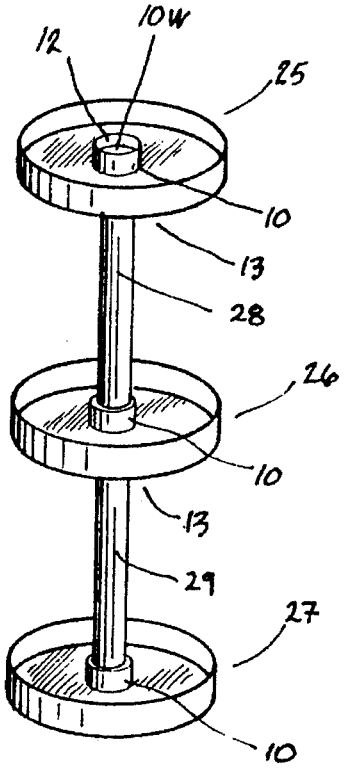
FIG. 6 illustrates two configurations of two container-bases connected by two stems to each other and a third uppermost container-base, all on a single vertical axis.

FIG. 6 illustrates three container-bases 25,26,27, forming basins such as those described as container-bases 2 and 3, but possibly varying in size and shape, as contemplated within the scope of the invention. Container-bases 25,26,27 are connected to each other by two stems 28,29, identical to stem 4, except possibly as to length within the scope of the invention. Stem 28 connects container-base 25 to container-base 26, and stem 29 connects container-base 26 to container-base 27 in a single vertical plane. In FIG. **6*a*, the container-bases are connected by lower cylindrical recessed sockets 13 and upper sockets 12**, in such a manner that all three container-bases can hold flowers, plants and water.

Figure 6B:
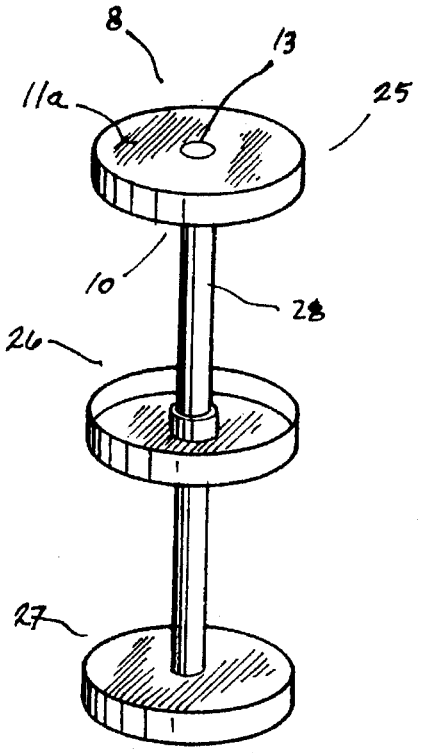

FIG. 6*b* illustrates container-base 25 as the top member upon which a potted plant may rest upon a flat surface when upper end of stem 28 is inserted into socket 12 of hub 10 (not shown). Container-base 27 rests on a horizontal surface with hub 10 (not shown) facing towards that surface.

Figure 7:
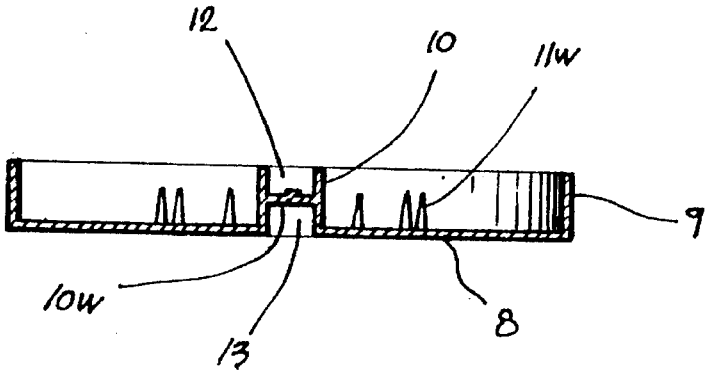
FIG. 7 is a diagram of a cutaway section of a container-base.

FIG. 7 illustrates a cutaway section of a container-base, revealing socket 12, web 1OW, and recessed socket 13, all within hub 10. One can see that the connections between the container-bases and the stems are leakproof, especially when the stems are hollow, because of the physical discontinuity, web 1OW, between socket 13 and socket 12. In addition to functioning as a leafproof barrier, web 10W also provides a mechanical barrier to prevent stems from slipping from socket to socket.

Figure 8:
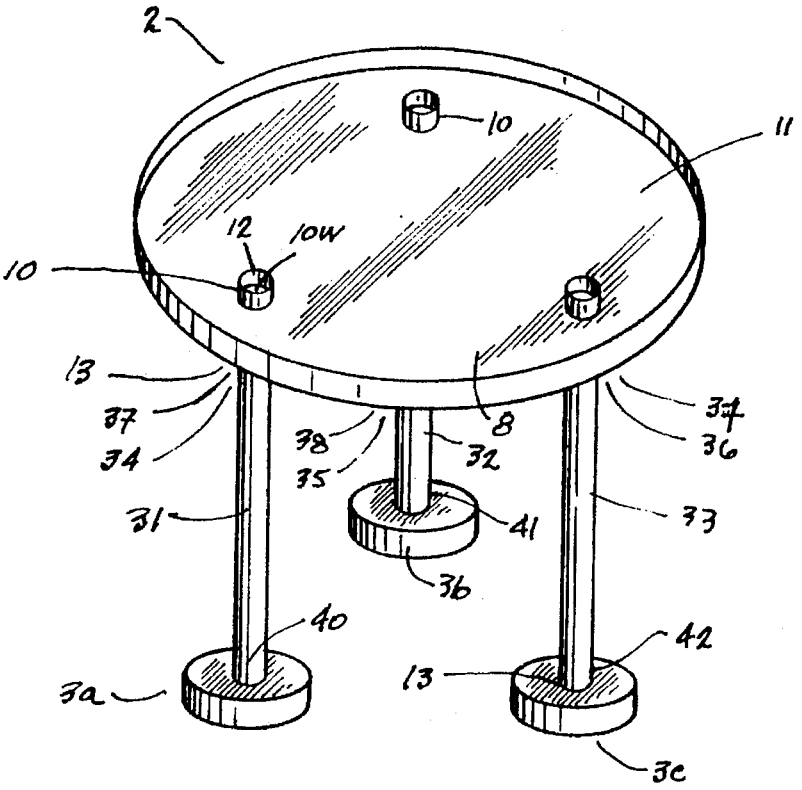
FIG. 8 illustrates a large upper container-base connected to and supported by three stems rising from sockets in three smaller container-bases.

FIG. 8 illustrates a container-base 2 connected to three stems 31,32,33. These stems are identical in structure to stem 4, except possibly as to height, as contemplated within the scope of this invention. Stems 31,32,33 are connected by their upper ends 34,35,36 and three sockets 37,38,39, identical in structure and dimension to socket 13, in flange 8 of top container-base 2. Each lower end 40,41,42 of each stem 31,32,33 fits into each recessed cylindrical socket 13 of three smaller container-bases 3*a*,3*b*, and 3*c*. These three container-bases are relatively smaller in size than container-base 2, but may be the same size with respect to each other. As illustrated here, stems 31,32,33 are in a triangular configuration and parallel to each other.

Figure 9:
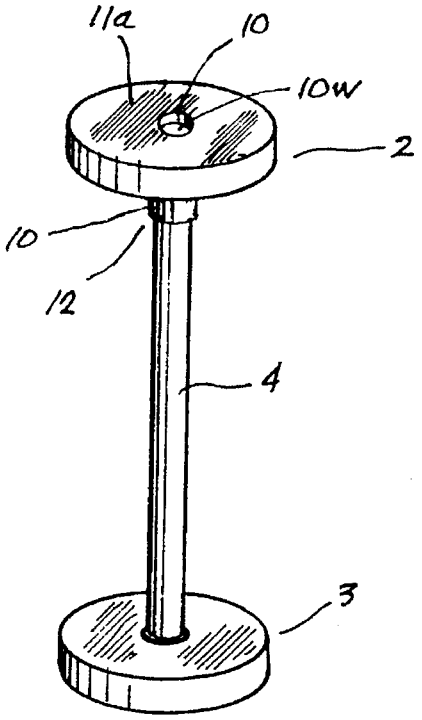
FIG. 9 demonstrates an arrangement which provides a horizontal surface on which to place a potted plant.

FIG. 9 illustrates container-base 2 connected to upper stem end 5 by socket 12 (not shown) in hub 10. In this manner, the top container-basin 2 provides a flat horizontal surface 11*a* on which a potted plant can rest.

Figure 10:
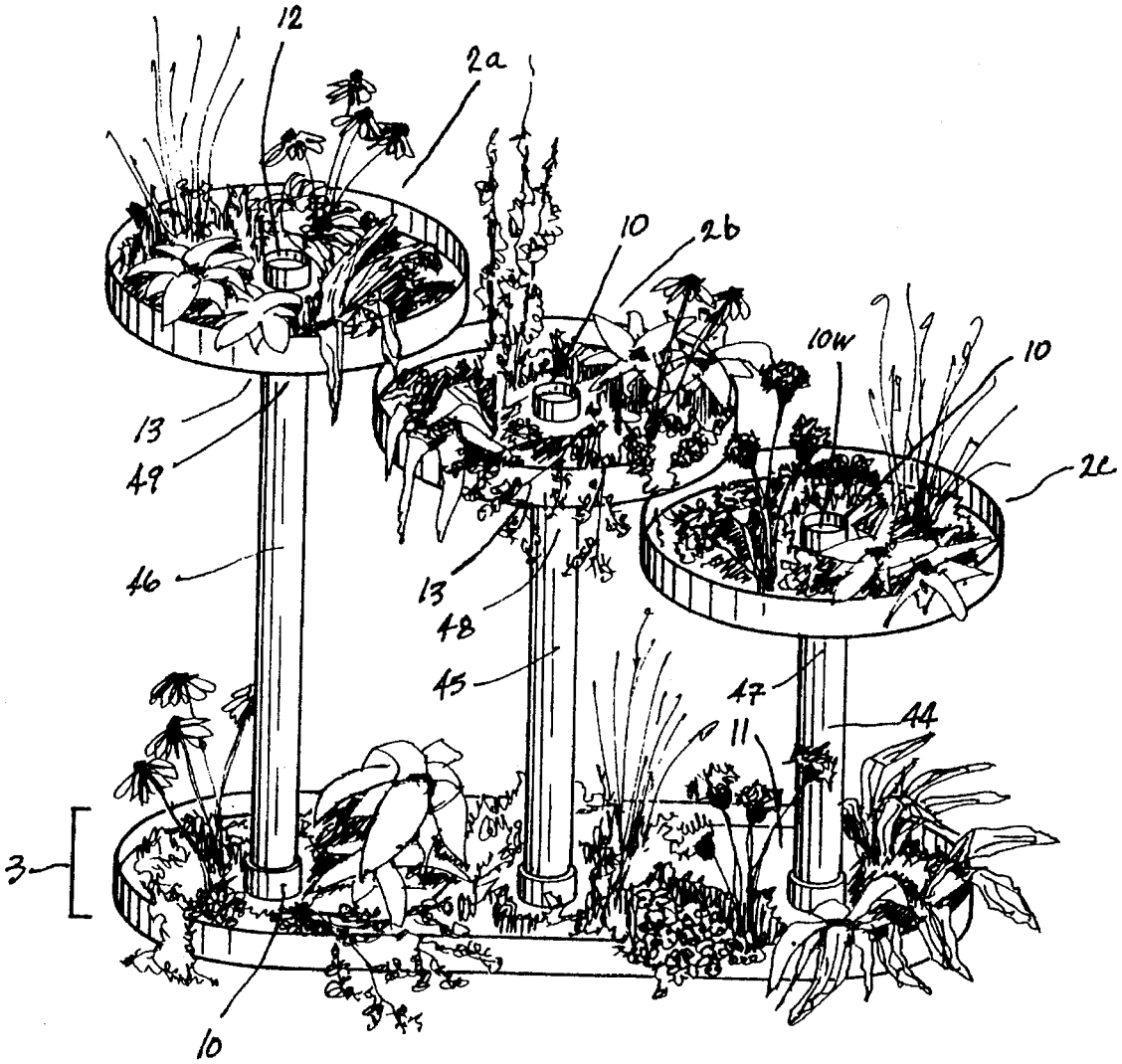
FIG. 10 illustrates an arrangement wherein three smaller container-bases are supported by stems above a larger container base.

FIG. 10 illustrates bottom container-base 3 connected by three stems 44,45,46 to three top container-bases 2*a*,2*b*,2*c*. All three top container-bases are considerably smaller than supporting bottom container-base 3, but may be the same size with respect to each other. Each of stems 44,45,46 are identical to stem 4 in structure, except for variations in height, which are within the scope of this invention. Each upper end 47,48,49 of stems 44,45,46 respectively are inserted into each socket 13 (not shown) of each top containerbase. In this manner, each top container-base may hold its own flower arrangement. Stems 44,45,46 may also be of different lengths, so that each top container-base is at a different height above container-base 3. Each stem 44,45,46 terminates in a hub 10 containing a socket 12 (not shown) protruding from container-base 3, which is resting stably on a horizontal surface.

Figure 11:
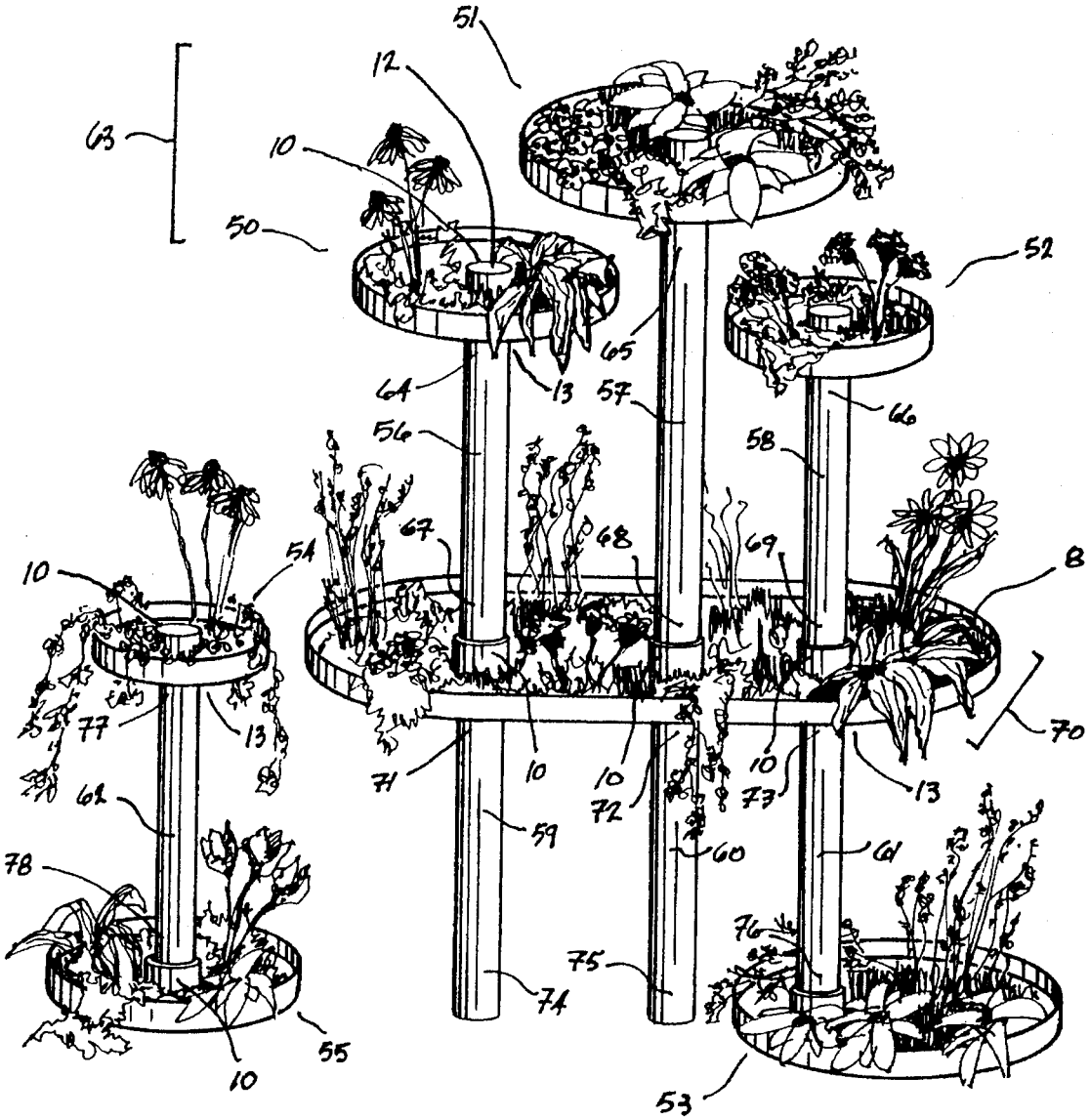
FIG. 11 illustrates an arrangement in which multiple stems of different lengths support small container-bases, as well as a larger container-base, while a spatially distinct small container- base is supported by one stem.

FIG. 11 illustrates a multi-tiered embodiment of the party riser 1. six small container-bases 50,51,52,53,54,55 are identical in structure to, but possibly differing in size from container-bases 2 and 3 of the preferred embodiment,and may be relatively the same size with respect to each other. These five container-bases are combined with a plurality of stems 56,57,58,59,60,61,62. These stems are identical in structure to stem 4, except as to different lengths, as contemplated within the scope of the invention. Stems 56,57,58 at their lower ends connect to container-base 70, which is relatively larger than container-bases 50,51,52,53,54,55. Three of the smaller container-bases 50,51,52 are staggered at upper position 63, and each is attached to the upper ends 64,65,66 of each stem 56,57,58 respectively. The bottom ends of each stem 67,68,69 are inserted into hubs 10 containing upper sockets 12 (not shown) along the upper surface 11 of flange 8 of container-base 70.

Extending downward from this large container-base 70 are three stems 59,60,61, each identical to stem 4 except as to varying height, which is contemplated within the scope of this invention. However, stems 59,60,61 must all be the same height relative to each other in this particular embodiment. Stems 59,60,61 are connected to container-base 70 by insertion of their upper ends 71,72,73 respectively into sockets 13 on the lower surface of flange 8 of container-base 70.

Two bottom ends 74,75 of stems 59,60 respectively directly contact a horizontal supporting surface. Stem 61 connects to bottom container-base 53 by insertion of lower end 76 into an upper socket 12 (not shown) of a hub 10. It can be seen from the figure that container-base 53 as well as stem ends 75,74 function as support.

Spatially separate from, but artistically a part of the foregoing structure are fifth and sixth container-bases 54,55. Container-base 54 is connected to bottom container-base 55 by stem 62. Stem 62 is identical to stem 4 in structure, but variable as to length, as contemplated within this invention. The upper end 77 of stem 62 fits into recessed socket 13. The lower end 78 of stem 62 inserts into upper socket 12 within hub 10 of container-base 55. Container-base 55 functions as support and a container on a horizontal surface for this physically separate component of the embodiment.

Figure 12:
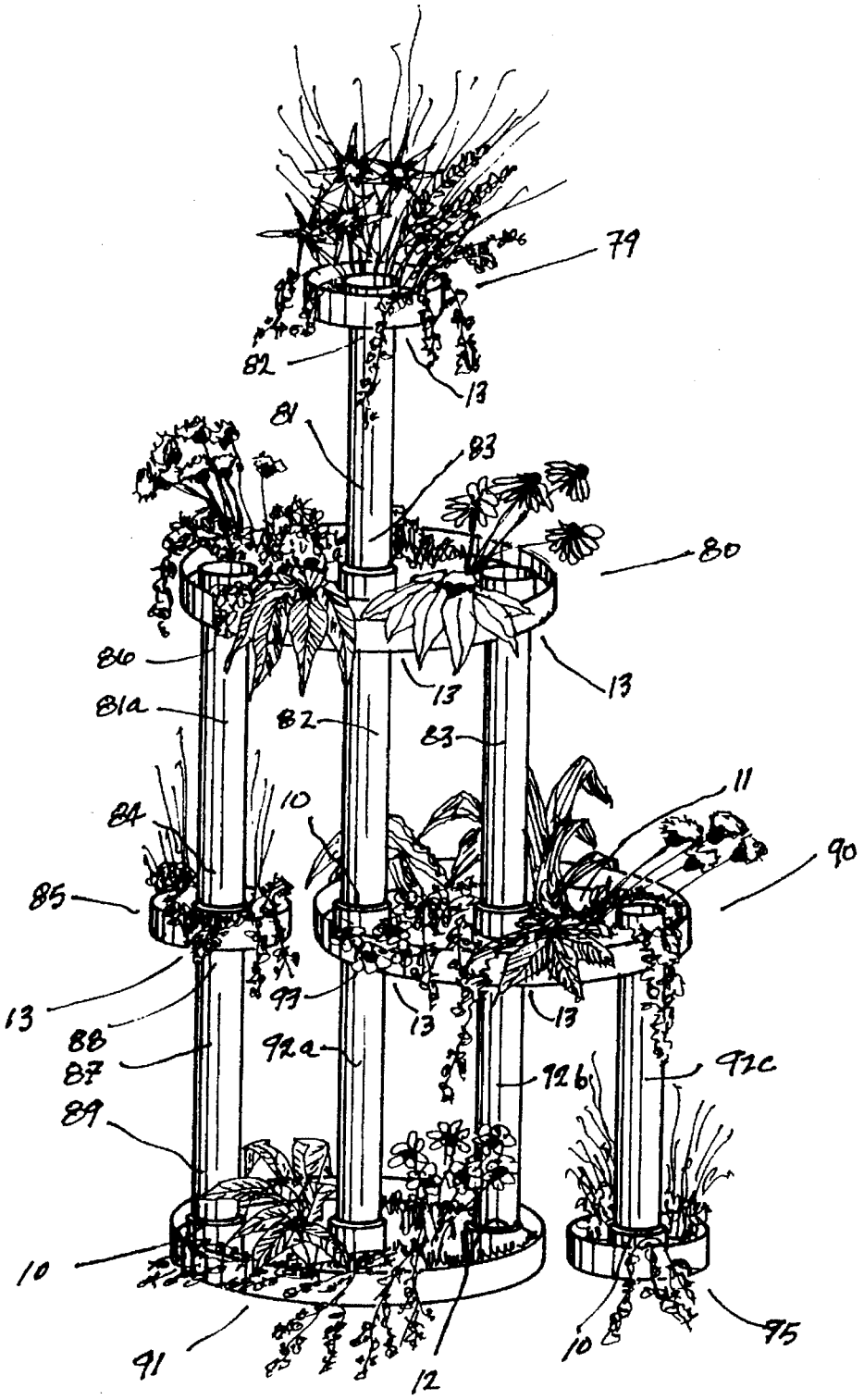
FIG. 12 illustrates an arrangement of numerous container-base connected with stems and containing flower arrangements.

FIG. 12 is also a multi-tiered embodiment of the party riser 1. The container-bases in this embodiment are identical in structure to container-bases 2 and 3, except for variation in size. The stems are identical in structure to stem 4 of the preferred embodiment, except for variation in length as contemplated within the scope of the invention.

Again referring to FIG. 12, and beginning from the top of this embodiment, there is a small container-base 79, which is connected to a second relatively larger container-base 80 by a stem 81. The upper end 82 of the stem 81 inserts into socket 13 (not shown, while lower end 83 inserts into upwardly extending socket 12 (not shown) within hub 10 in container-base 80. Both container-bases may contain flowers or other party decorations.

Extending downward from container-base 80 are three stems 81*a*, 82,83. The first stem 81*a*, by its lower end 84, connects to a small container-base 85 by means of socket 12 within a hub 10. Its upper end 86 fits into recessed socket 13 of container-base 80. Continuing downward from container-base 85 is another stem 87 whose upper end 88 fits into recessed socket 13 on container-base 85. The lower end 89 of stem 87 terminates in upper socket 12 in hub 10 on a container-base 91. Container base 91 provides support for the party riser 1 on a horizontal surface.

Stem 82 is attached at its upper end to a recessed socket 13. Stem 82 terminates in a upper socket 12 in a hub 10 on the periphery of container-base 90. Extending downward from container-base 90 coaxially from where stem 82 terminates is stem 92*a*. Stem 92*a* inserts into socket 13 of container-base 90 by its upper end 93. Stem 92*a* terminates in a centrally located socket 12 within a hub 10 of container-base 91.

Stem 83 extends downward from a peripheral socket 13 in container-base 80 and terminates in a socket 12 within a centrally located hub 10 in container-base 90. Stem 92*b* extends coaxially from socket 13 in centrally located hub 10 and connects to the periphery of container-base 91. Stem 92*c* extends downward from a peripherally located socket 13 of container-base 90 and terminates in a centrally located socket 12 within hub 10 of container-base 95. Both container-bases 95 and 91 function as supports on a horizontal surface.

To assemble a kit containing the components required to construct numerous and varied party risers, the container-bases such as 2 and 3 may be of different sizes and shapes. As such, there may be a first plurality of container-bases, each sized differently from a second plurality of container-bases within a particular kit. The scope of this invention also includes a kit wherein a first plurality of cylindrical stems has a greater length than a second plurality of stems, and this feature can be incorporated into the previous kit with two groups of container-bases. Similarly, there can be a third set of stems and container-bases in a kit, depending upon the price and the size of the kit, and the purchaser's preferences. Another alternative for a kit would be container-bases of the same shape but different sized flanges and stem lengths.

As one can see, the permutations of the embodiments of the invention quickly become astronomical. However, what must remain constant in each kit intended for the assembly of party risers is the dimensions of the circular partially hollow hub 10. The components of the hub, an upper socket 12, web 10*w* and lower socket 13 must also always be identical in size, shape and dimension within a kit. They must also fit tightly and easily onto the upper and lower ends of every stem such as stem 4.

Similarly, stems in each kit must have dimensionally identical ends to fit into all sockets, unless they are hollow and designed to fit over all hubs functioning as male members. A kit can contain both types of stems as components within the scope of this invention. In this manner either end of the rigid cylindrical stem such as stem 4, with ends such as 5 and 6 in FIG. 1, fit frictionally into or over any upper socket 12 or into socket 13 within hub 10 of any container-base. This also means that although the length of any stem, otherwise identical in structure to stem 4, can vary, stems cannot vary as to diameter, or else they cannot be interchangeable, by an interference fit, within all upper and lower sockets.

Figure 13:
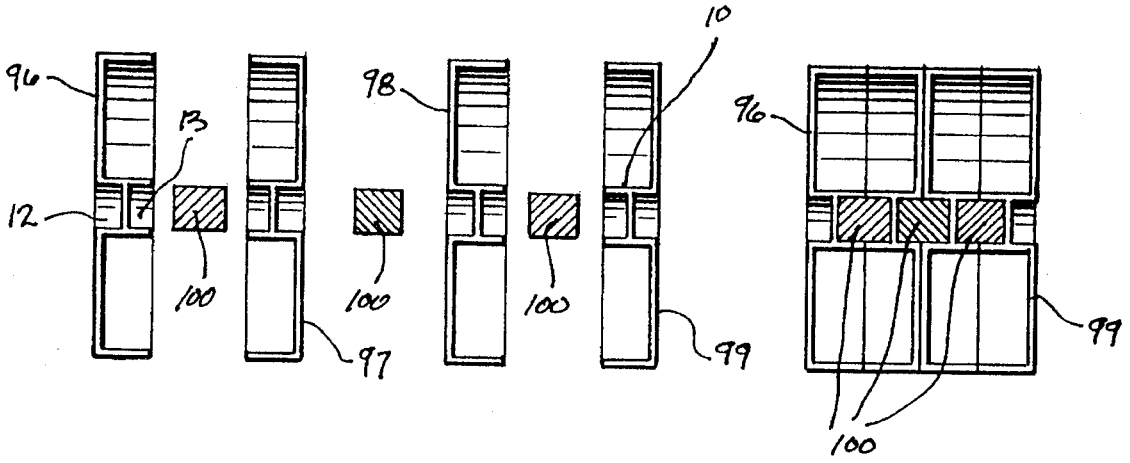
FIG. 13 illustrates an arrangement with only a bottom container-base.

The invention also encompasses compact delivery by means of styrofoam plugs. As shown in FIG. 13, container-bases 96,97,98,99, can be consolidated by means of styrofoam plugs 100. These plugs 100 can fit into sockets 12 and 13 of container-bases and hold them together in a smaller volume.

Figure 14:
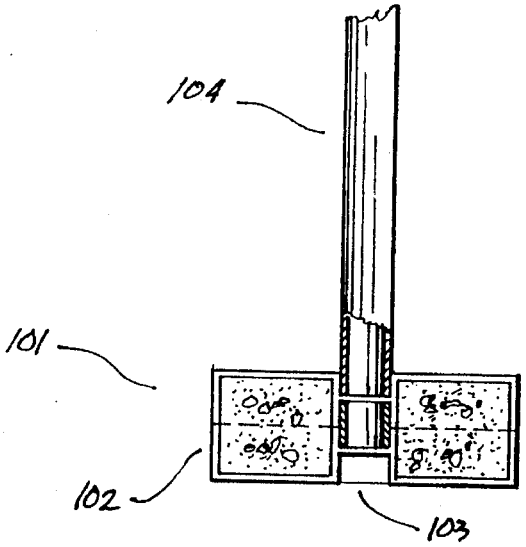
FIG. 14 illustrates a container-base filled with plaster or concrete.

The invention also contemplates combining container-bases for a heavier support as seen in FIG. 14. In this embodiment, container-base 101 and an opposing container-base 102 are filled with plaster or concrete with a short pipe 103 to lock both container-bases together. In this manner one can use a very large stem 104, different in structure and diameter from stem 4, supra, which may also accompany the kit. The florist may then strive for a candelabra effect.

The party riser need not be elevated until it has been delivered to its destination, where it can be easily assembled. The absence of glue or other adhesive means is a functional benefit: after the festivities are completed, a guest may easily remove a top or bottom container-base, and bring the floral or plant arrangement home. Similarly, whoever is responsible for assembling or disassembling the decorations for the festivities can do so in an expeditious manner.

Moreover, an important economic advantage of the invention is that the florist retains a significant portion to reuse, even if a guest keeps a container-base with its flowers or plants. The florist can simply re-order separate container-bases to refurbish inventory at low cost.

In sum, the party riser is capable of configurations in several combinations, with easy delivery and assembly on site in seconds, and without the annoyance of glue. Another crucial feature of the invention is that the upper socket 12, web 10W and lower socket 13 within hub 10, together with cylindrical thin rigid stems such as 4, interconnect in a leakproof manner. Because of this feature water and flowers can be placed directly into container-bases without an intervening plastic liner or vase. In addition, the invention is generally comprised of a molded resinous material which is available in a vast array of hot-stamped finishes. In the preferred embodiment, plastic resin, such as polystyrene, which can be hot-stamped, is used. The invention can also be formed by injection molding, generally at a central hub.

In other embodiments, the lower surface 11*a* of flange 8 need not be flat, and may even be rounded with short legs. The lower surface 11*a* of flange 8 can also contain a narrow rim approximately one-half inch in height and approximately one-quarter inch in thickness, as a barrier to prevent decorative pieces from toppling. This added feature is particularly useful when surface 11*a* is used as the supporting surface for a decorative object. However, the rim is not limited to these particular dimensions, and other measurements are also within the scope of this invention.

In the preferred embodiment of the invention, the reversible container-bases such as 2 and 3 are circular. However, they can be any shape, including, but not limited to, square, rectangular, triangular, or hexagonal. The structures so placed upon a table top or other horizontal surface allow the beauty of floral or plant decorations without obstructing the view of persons conversing with each other across that table or surface. In addition, for an evening event, hub 10 can also hold an electric candle, with a battery pack concealed in a bottom container-base In yet another embodiment of the invention, there is no upper or top container-base. Instead, the bottom container-base, such as 3, as support on a horizontal surface, is connected to a hollow rigid stem 4, by its socket 12 within hub 10 on the upper surface 11 of flange 8. A bridal bouquet or perhaps a bridesmaid's bouquet, is then inserted into the upper end of the hollow stem 4. In this manner, the bouquet can be displayed on a horizontal surface for the remainder of the festivities and remain fresh if the hollow stem contains water. In addition, for an evening event, a special touch in the bottom container base, such as 3, would be votive candles, as any bottom container-base, if attached to the stem by a socket 12, can also function as a basin as well as a support.

As can be seen from the above descriptions, one of the crucial features of the invention is the reversibility of the container-base. This is because one of the linchpins of the invention is that each container-base has a dual function. For example, the bottom container-base may function as both a support for the entire party riser 1 and as a basin for a block of floral foam in water containing a flower arrangement, if upper socket 12 is protruding upward from a flange 8 resting on a horizontal surface. This arrangement adds weight to the base and consequently gives more stability to the entire party riser 1.

This same bottom container-base, such as 3, can be flipped over and function solely as a support if socket 13 is facing upwards and exposed for receiving a stem, such as 4. In sum, because every container-base in a kit has at least one upper and lower coaxial socket within a hub, a container-base can be merely a support, or function simultaneously as a support and basin for flowers or other decorations.

The number of party risers that can be assembled from a single kit is limited only by the actual number and acceptable variations of stems and container-bases, contemplated within the scope of the invention as discussed supra. In addition, party riser components can be distributed in kits of several sizes.

What we claim is:

1. A kit adapted to form a floral display arrangement comprising in combination, at least two container-base elements each having a hub with predetermined height, and a top and a bottom surface and defining upper socket and lower sockets, each container-base element also having a flange extending from said bottom of said lower socket to a peripheral rim, said rim extending upward from said flange to a height equal to that of said hub whereby said hub, said flange and said rim define a basin adapted to hold water and a floral display, said kit further including at least one cylindrical stem having an upper and lower end adapted to form a friction fit with either of said upper and lower sockets.

2. The kit as defined in claim 1 wherein a first and second said container-base are completely interchangeable with all said ends of said stems.

3. The kit as described in claim 1 wherein a plurality of said stems are hollow and fit over all said hubs, said hubs thus functioning as male members when said floral arrangement is assembled.

4. The kit as described in claim 1 wherein a first plurality of said cylindrical stems each have a greater length than a second plurality of said stems.

5. The method for producing a kit according to claim 1 comprising the step of injection molding said stems and said container-bases with said plastic resins.

6. A kit adapted to form a floral display arrangement comprising in combination, at least two container-bases each having a hub with a predetermined height, each said hub having a web, said web further comprising a top and bottom surface defining an upper and a lower socket, each said container-base element also having a flange extending from the lower surface of said hub to a peripheral rim, said rim extending upward from said flange to a height approximately equal to that of said hub whereby said hub, said flange and said rim define a basin adapted to hold water and a floral display, said kit further comprising at least one cylindrical stem, said stem having an upper and lower end adapted to form a friction fit with either of said upper and lower sockets.

7. A kit as described in claim 6 wherein (A) said flange has (i) an upper and lower surface (ii) a predetermined two dimensional area and (iii) predetermined thickness and (B) said rim has a predetermined interior height.

8. The kit as described in claim 6 wherein said hub and said sockets are cylindrical in shape.

9. The kit as described in claim 7 wherein said lower surface of said flange is recessed to form said lower socket, and said upper socket is coaxial with said lower socket within said hub.

10. The kit forming a floral display arranged when assembled, as described in claim 7, consisting solely of one said stem and two said container-bases, (a) said container-bases being identical to each other in shape and two-dimensional area of said flanges, (b) said container- bases each further comprising a centrally located said hub upon said upper surface of said flange (i) said hub containing said web and two said sockets in coaxial alignment (c) said floral display arrangement approximately 24 inches in height when assembled.

11. The kit as described in claim 7 consisting solely of one said stem and a first and a second said container-bases, (a) said first container-base having a larger two-dimensional area of said flange than said second container-base, (b) said container-bases each further comprising a centrally located said hub on said upper surface of said flange (i) each said hub containing said web and two said sockets in coaxial alignment.

12. The kit as described in claim 7 wherein said container-base comprises spikes protruding from said upper surface of said flange, said spikes being shorter than the interior height of said rim.

13. The kit as described in claim 6 comprising a floral disaply arrangement when assembled, wherein said web comprises (A) a substantially leakproof barrier between said stems and said container-bases and (B) a mechanical barrier between said stems after said floral display arrangement is assembled.

14. The kit as described in claim 7 wherein (A) said hub is approximately one and one-half inches in height and approximately one and one quarter inches in interior diameter, and (B) said flanges are circular and approximately eight inches in diameter and approximately 1.5 inches in thickness, and (c) said assembled floral display is approxiomately 24 inches high.

15. The kit as described in claim 6 wherein at least one said flange is rounded with short legs.

16. The kit as described in claim 7 wherein said hub protrudes from said upper surface of said flange to approximately the height of said rim.

17. The kit as described in claim 6 wherein said container-bases and said stems are comprised of hot-stamped plastic resins.

18. The kit as described in claim 6 wherein a plurality of said flanges each contain more than one said hub.

19. The kit as described in claim 6 wherein at least two said hubs are located on each of a plurality of said flanges, said upper and lower sockets coaxial to each other within each said hub.

20. The kit as described in claim 7 wherein a first plurality of said container-bases have flanges each of a greater two dimensional area from a second plurality of said container-bases.

21. The kit as described in claim 7 comprising:

(A) a first plurality of said container-bases, (B) a second plurality of said container-bases, said second plurality having a greater two dimensional area for each flange than said first plurality, (C) a third plurality of container-bases, said third plurality having a greater two dimensional area for each said flange than said second plurality, (D) a first plurality of said stems, (F) a second plurality of stems, said second plurality having a greater length of each said stem than said first plurality, (G) a third plurality of stems, said third plurality having a greater length of each said stem than said second plurality.

22. A kit adapted to form a display arrangement with components comprising in combination:

(A) container-bases, each said container-base further comprising at least one hub, each said hub having a predetermined height (1) each said hub further comprising a web with a top and bottom surface, said top and bottom surfaces defining upper and lower sockets respectively each said container-base further comprising a flange (i) said flange extending each said web to a peripheral rim, each rim having an inner and outer surface, (ii) each such flange having an upper and lower surface, (iii) each said rim extending upwardly from said upper surface of said flange to a height approximately equal to that of each said hub, as measured from said upper surface of said flange, wherein said hubs, said flange, and said rim define a container-base, (3) a second plurality of said container-bases each individually having a greater area than a first plurality, (ii) a third plurality of said container-bases each individually having a greater area than said second and first pluralities, (B) cylindrical stems, each said stem having an upper end and a lower end adapted to form a frictional fit with either of said upper or said lower sockets, there being at least a first, second and third plurality cf said stems (i) said second plurality of stems each having a greater length than said first plurality, (ii) said third plurality of said stems each having a greater length than said second plurality whereby said stems and container-bases are assembled to form a variety of rigid structures known as party risers, each said container-base adapted to support a floral display or to function as a base.

* * * * *